US010697618B2

(12) United States Patent
Zich et al.

(10) Patent No.: US 10,697,618 B2
(45) Date of Patent: Jun. 30, 2020

(54) INSULATED ENCLOSURE FOR RECESSED LIGHT FIXTURE

(71) Applicants: Jerrold R. Zich, Bull Valley, IL (US); Clifford R. Jackson, Jr., Crystal Lake, IL (US); Brett T. Jackson, Crystal Lake, IL (US); Ryan C. Jackson, McHenry, IL (US)

(72) Inventors: Jerrold R. Zich, Bull Valley, IL (US); Clifford R. Jackson, Jr., Crystal Lake, IL (US); Brett T. Jackson, Crystal Lake, IL (US); Ryan C. Jackson, McHenry, IL (US)

( * ) Notice: Subject to any disclaimer, the term of this patent is extended or adjusted under 35 U.S.C. 154(b) by 27 days.

(21) Appl. No.: 15/900,142

(22) Filed: Feb. 20, 2018

(65) Prior Publication Data

US 2018/0172250 A1 Jun. 21, 2018

Related U.S. Application Data

(63) Continuation-in-part of application No. 14/711,318, filed on May 13, 2015, now abandoned.

(60) Provisional application No. 61/992,508, filed on May 13, 2014.

(51) Int. Cl.

| | |
|---|---|
| ***F21V 15/01*** | (2006.01) |
| ***F21S 8/02*** | (2006.01) |
| ***F21V 21/04*** | (2006.01) |
| ***F21V 15/00*** | (2015.01) |
| *F21V 29/15* | (2015.01) |
| *F21V 17/00* | (2006.01) |
| *F21V 29/85* | (2015.01) |

(52) U.S. Cl.

CPC ..... *F21V 21/047* (2013.01); *F21S 8/026* (2013.01); *F21V 15/00* (2013.01); *F21V 15/01* (2013.01); *F21V 17/007* (2013.01); *F21V 29/15* (2015.01); *F21V 29/85* (2015.01)

(58) Field of Classification Search

CPC ..... F21V 21/04; F21V 29/85; F21V 15/01; F21V 17/007; F21V 21/047; F21S 8/026; B65D 71/40; B65D 85/62; H02G 3/08

See application file for complete search history.

(56) References Cited

U.S. PATENT DOCUMENTS

| | | | | |
|---|---|---|---|---|
| 4,754,914 A * | 7/1988 | Wischusen, III | .... | A47G 21/001 229/87.08 |
| 6,105,334 A * | 8/2000 | Monson | ..... | F21S 8/02 52/232 |
| 6,286,980 B1 * | 9/2001 | Meyer | ..... | F21S 8/02 362/294 |

* cited by examiner

*Primary Examiner* — Andrew T Kirsch

(74) *Attorney, Agent, or Firm* — Olson & Cepuritis, Ltd.

(57) ABSTRACT

A blank for an enclosure for a recessed light fixture in an attic comprises a sheet of a thermally resistant material subdivided into a plurality of square panels by living hinges. The panels are foldable to provide a housing for the recessed light fixture. A package of blanks is constituted by a pair of such sheets, each sheet having a panel pivoted against an adjacent panel of same sheet in a back-to-back relationship when the sheets are juxtaposed relative to one another.

5 Claims, 5 Drawing Sheets

INSULATED ENCLOSURE FOR RECESSED LIGHT FIXTURE

CROSS-REFERENCE TO RELATED APPLICATION

This application is a continuation-in-part of U.S. patent application Ser. No. 14/711,318, filed on May 13, 2015, and also claims the benefit of U.S. Provisional Application No. 61/992,508, filed on May 13, 2014, both applications being incorporated herein by reference in their entireties.

FIELD OF INVENTION

This invention relates to housings for recessed light fixtures in an attic.

BACKGROUND OF INVENTION

Ceilings in homes are commonly insulated by a loose fill insulation, usually fiberglass and the like. Recessed light fixtures installed in such ceilings can create drafts coming in through the light fixture, contribute to heat loss by air flow past the recessed light fixture, and transfer humidity into the home from the recessed light.

The present invention provides a means for minimizing undesirable air flow past recessed light fixtures installed in an attic.

SUMMARY OF INVENTION

A cubical enclosure for a recessed light fixture in an attic is provided by means of a blank which is transformable from a flat configuration into a cubical housing that envelops a recessed light fixture.

In a preferred embodiment the blank is a cruciform sheet of a thermally resistant material provided with spaced intersecting living hinges that define the sheet into five connected square panels of substantially the same size and overall dimensions. Each living hinge permits pivoting movement of adjacent panels of at least 90 degrees but no more than 270 degrees. More particularly, the cruciform sheet defines first and second pair of uniformly spaced living hinges, the living hinges in each pair being parallel to one another. The living hinges of one pair intersect the living hinges of the other pair at a right angle.

In an alternate embodiment, the blank is a square sheet of a thermally resistant material provided with spaced intersecting living hinges that define the sheet into nine square panels each having substantially the same size and overall dimensions. Prior to transformation of this particular blank into a cubical housing, the four corner panels of the sheet are removed to provide the aforementioned cruciform configuration.

The aforementioned blanks can be compactly packaged by folding one or more of the panels 180 degrees against an adjacent panel in a back-to-back relationship and juxtaposing the sheets relative to one another so that the folded back panels abut one another.

DETAILED DESCRIPTION OF PREFERRED EMBODIMENTS

Figure 1:
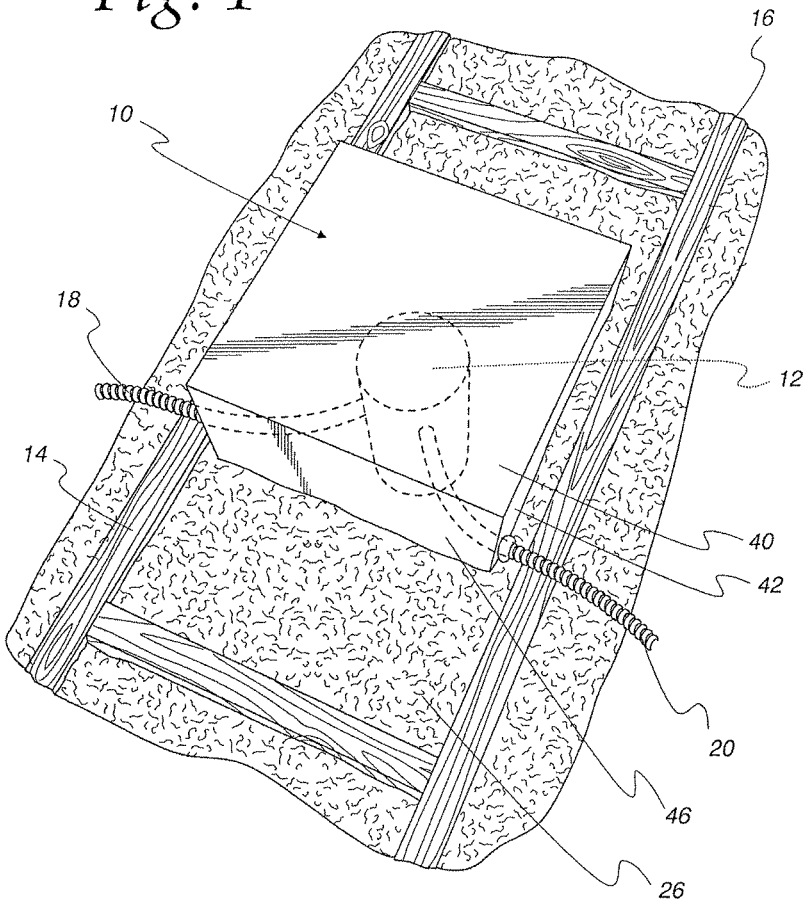
FIG. 1 is a perspective view of an enclosure for a recessed light fixture installed over the light fixture.

Referring to FIG. 1, enclosure 10, constituted by joined panels of a thermally resistant material, envelops recessed light fixture 12 in an attic, mounted between framing members 14 and 16. Conduits 18 and 20 are operably connected to light fixture 12. A bead of insulation such as polyurethane foam bead 22 provides an insulating seal between enclosure 10 and ceiling 24. The space between framing members 14 and 16 can be filled with insulation 26, if desired.

Figure 2:
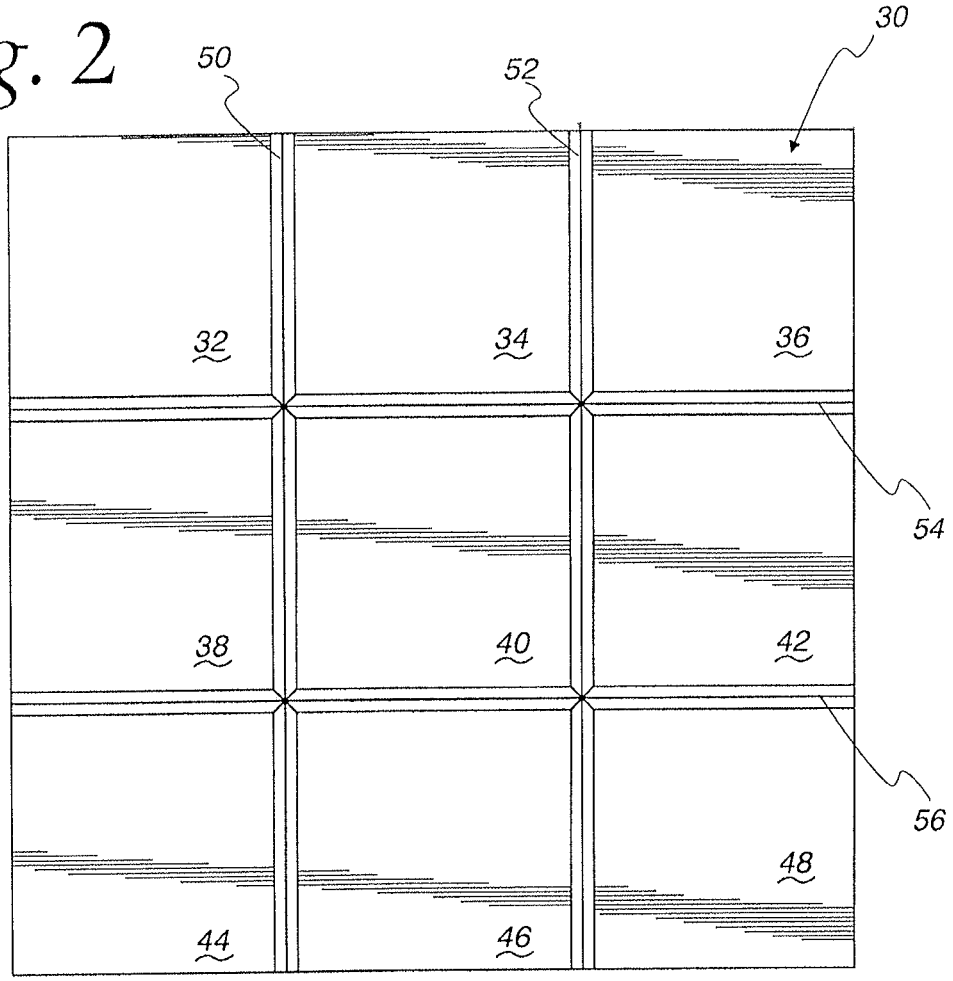
FIG. 2 is a plan view of a blank suitable for forming the enclosure of FIG. 1.
Figure 3:
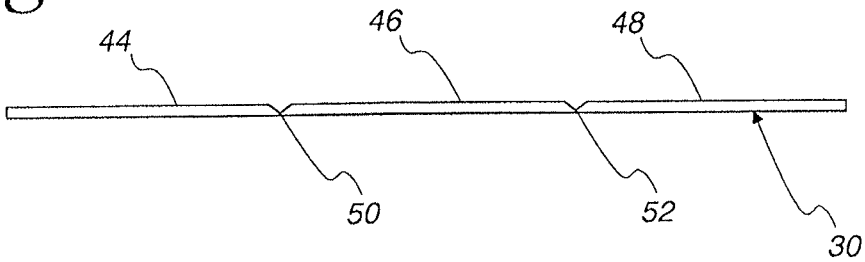
FIG. 3 is a side elevation view of the blank shown in FIG. 2.

A blank suitable for forming enclosure 10 is shown in FIGS. 2 and 3. In particular, blank 30 is a square sheet of a thermally resistant material partitioned by pairs of spaced living hinges 50, 52, 54 and 56 into exactly nine square panels 32, 34, 36, 38, 40, 42, 44, 46 and 48 having substantially the same shape and overall dimensions. One pair of living hinges, i.e., living hinge 50 and living hinge 52, intersects another pair of living hinges, i.e., living hinge 54 and living hinge 56, at right angles.

The term "living hinge" as used herein and in the appended claims is a relatively thin flexure bearing made of the same material as the adjacent panels it connects, but thinner than the panels. Living hinges keep the panels together but allow the panels to fold or pivot relative to one another. Preferably, thickness of the living hinge is no more than one sixteenth the thickness of adjacent panels.

Figure 4A:
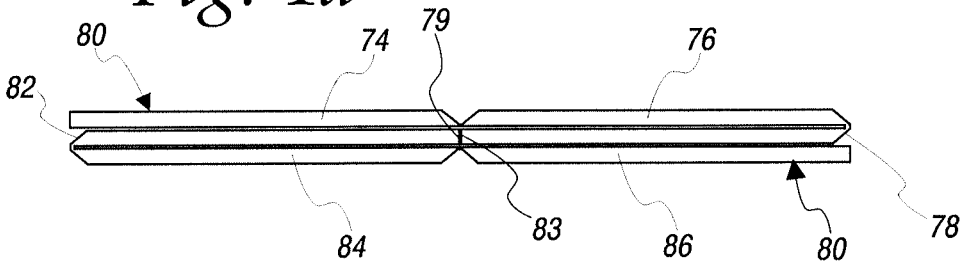
FIG. 4*a* is a side elevation of a compact package comprising a pair of blanks shown in FIG. 2.
Figure 4B:
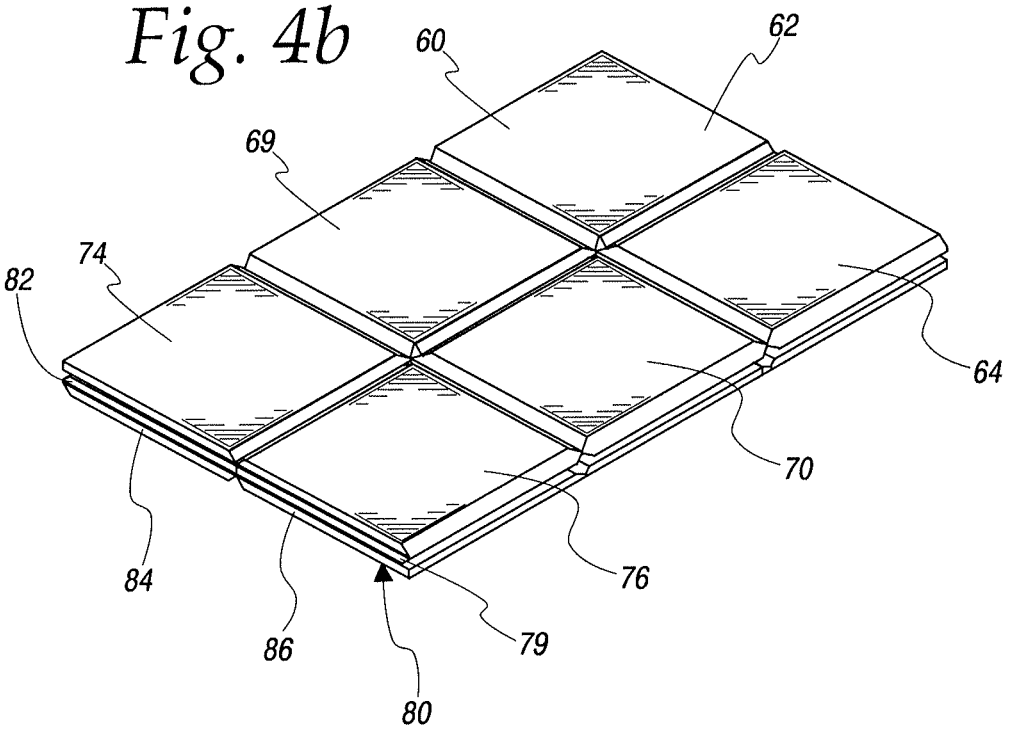
FIG. 4*b* is a perspective view of a compact package comprising a pair of blanks shown in FIG. 2.

A compact package of blanks such as blank 30 can be formed for storage and shipping as shown in FIGS. 4*a* and 4*b*. Blanks 60 and 80, having the same configuration as blank 30 shown in FIGS. 2 and 3, are juxtaposed relative to one another. One row of panels in blank 60, i.e., the row beginning with panel 78, is folded back or pivoted about 180 degrees against an adjacent row of panels, i.e., panels 76, 70 and 64, in a back-to-back relationship. Similarly, one row of panels in blank 80, i.e., the row beginning with panel 82, is folded back against an adjacent row of panels, i.e., the row beginning with panel 84, in a back-to-back relationship. Blanks 60 and 80 with panels folded as described hereinabove are juxtaposed relative to one another so that outside edges of the folded back row of panels are juxtaposed relative to one another as illustrated by outside edge 79 of panel 78 abutting outside edge 83 of panel 82.

Typical size for a blank of nine panels is 36 inches by 36 inches, with each square panel measuring 12 inches by 12 inches. Thickness of the blank can vary, but usually is about ½ inch to about ¾ inch. All panels in a blank have substantially the same size and overall dimensions.

To form the insulating enclosure such as enclosure 10, four corner panels 32, 36, 44 and 48 are removed, and the five remaining joined panels, i.e., panels 34, 38, 40, 42 and 46 are folded to form the inverted, box-like structure of enclosure 10.

Edges of individual panels that are contiguous with the living hinges preferably are beveled as illustrated in FIGS. 2 and 3. In this manner pivoting movement of individual panels through an arc of 90 degrees to 270 degrees can be provided.

Figure 5:
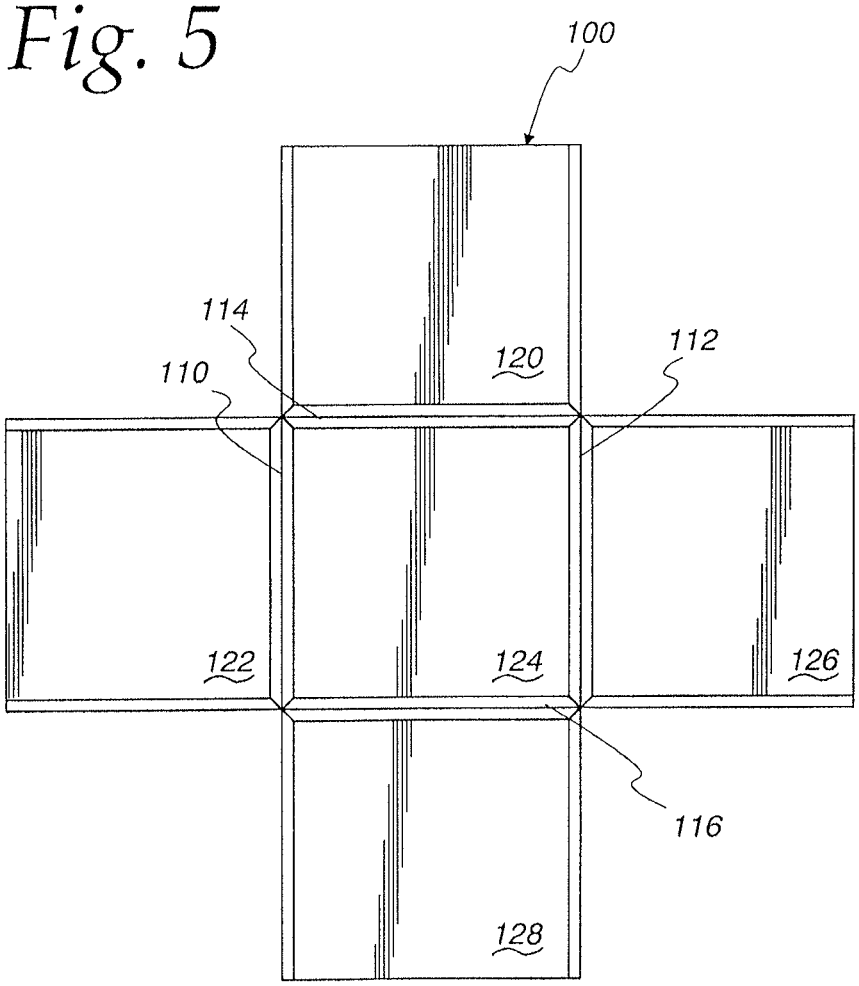
FIG. 5 is a plan view of another blank suitable for forming the enclosure of FIG. 1.

An alternate, cruciform configuration of a blank suitable for forming the insulated enclosure is shown in FIG. 5. In this particular embodiment, blank 100 is a sheet of thermally resistant material having a cruciform configuration with living hinges 110, 112, 114, 116 partitioning blank 100 into five square panels 120, 122, 124, 126, 128 having substantially the same shape and overall dimensions. To form the insulating enclosure, panels 120, 122, 124, 126 and 128 are folded to form an insulated, inverted box-like cubical structure similar to enclosure 10.

Figure 6A:
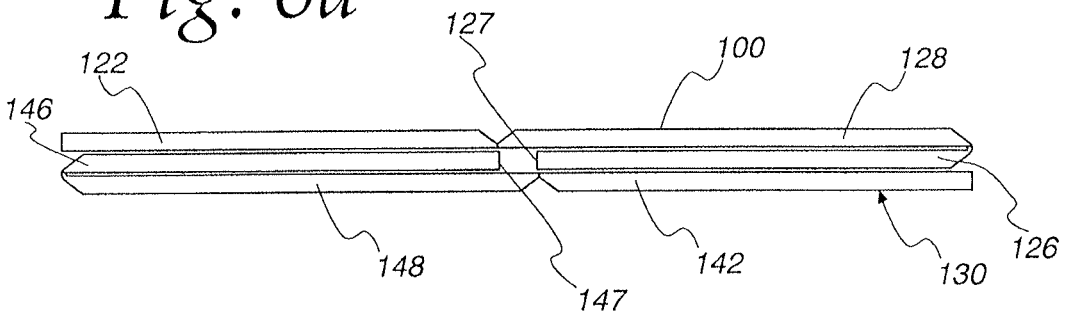
FIG. 6*a* is a side elevation of a compact package comprising a pair of blanks shown in FIG. 5.
Figure 6B:
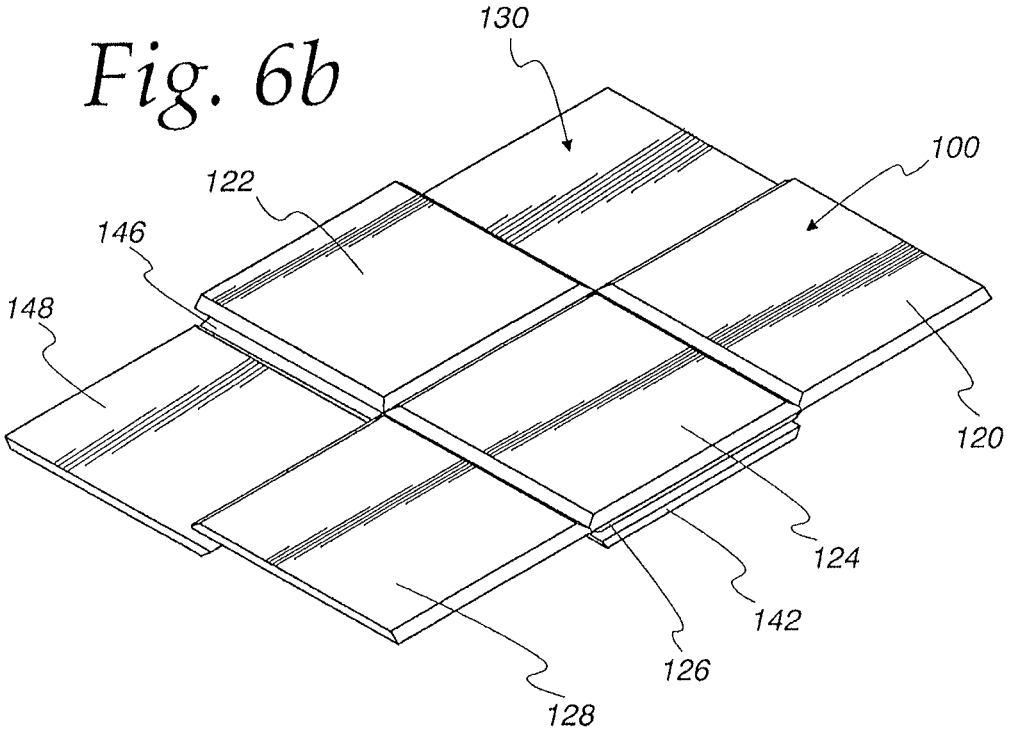
FIG. 6*b* is a perspective view of a compact package comprising a pair of blanks shown in FIG. 5.

A compact package of two cruciform sheets 100 and 130 having the same configuration as cruciform sheet depicted in FIG. 5 is shown in FIGS. 6*a* and 6*b* which show sheets 100 and 130 juxtaposed relative to one another. Sheet 100 has panel 126 pivoted or folded under panel 124. Sheet 130 has panel 146 pivoted or folded over a panel adjacent to panel 148 in a back-to-back relationship. Edge 127 of panel 126 is juxtaposed relative to edge 147 of panel 146. Panel 142 is juxtaposed with panel 126 as shown in FIG. 6*b*. Likewise, panel 146 is juxtaposed with panel 122.

Suitable materials of construction for the aforedescribed blanks are vinyl-coated, extruded polyethylene sheet, and the like.

The foregoing description is illustrative, but is not to be taken as limiting. Still other variants within the spirit and scope of the invention are possible and will readily present themselves to those skilled in the art.

The invention claimed is:

1. A blank suitable for forming a cubical enclosure for a recessed light fixture in an attic which comprises a square sheet of a thermally resistant material defining first and second pair of intersecting, uniformly spaced, parallel living hinges across the sheet;

said first pair intersecting said second pair at a right angle; and said first pair and said second pair together defining nine square panels.

2. A blank for an enclosure for a recessed light fixture in an attic which comprises a cruciform sheet of a thermally resistant material defining first and second pair of uniformly spaced, parallel living hinges;

said first pair intersecting said second pair at a right angle;

said first pair and said second pair together defining five square panels, said panels having beveled edges contiguous with the living hinges; and each living hinge allowing pivoting movement of a contiguous panel through an arc of at least 90 degrees but no more than 270 degrees.

3. A package of blanks for an enclosure for a recessed light fixture in an attic which package comprises a pair of cruciform sheets in accordance with claim 2, each sheet having a panel pivoted about 180 degrees against an adjacent panel of same sheet in a back-to-back relationship, and said sheets being juxtaposed relative to one another.

4. A package of blanks suitable for forming an enclosure for a recessed light fixture in an attic which package comprises a pair of square sheets in accordance with claim 1, each sheet having three contiguous panels pivoted about 180 degrees against adjacent panels of same sheet in a back-to-back relationship, and said sheets being juxtaposed relative to one another.

5. A package of blanks suitable for forming an enclosure for a recessed light fixture in an attic which package comprises a pair of cruciform sheets in accordance with claim 3, each sheet having a single contiguous panel pivoted about 180 degrees against an adjacent panel of the same sheet in a back-to-back relationship, and said sheets being juxtaposed relative to one another.

* * * * *